US011069981B2

(12) United States Patent
Raya et al.

(10) Patent No.: US 11,069,981 B2
(45) Date of Patent: Jul. 20, 2021

(54) RADIATING CABLE AND METHOD OF MANUFACTURING A RADIATING CABLE WITH AN INNER AND OUTER CONDUCTOR, EACH HAVING OPENINGS

(71) Applicant: NOKIA SHANGHAI BELL CO., LTD., Shanghai (CN)

(72) Inventors: Moustafa Raya, Magdeburg (DE); Erhard Mahlandt, Hannover (DE)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 0 days.

(21) Appl. No.: 16/495,954

(22) PCT Filed: Mar. 23, 2018

(86) PCT No.: PCT/CN2018/080218
§ 371 (c)(1),
(2) Date: Sep. 20, 2019

(87) PCT Pub. No.: WO2018/177209
PCT Pub. Date: Oct. 4, 2018

(65) Prior Publication Data

US 2020/0136224 A1 Apr. 30, 2020

(30) Foreign Application Priority Data

Mar. 27, 2017 (EP) ..... 17163158

(51) Int. Cl.
*H01Q 13/20* (2006.01)
*H01P 3/06* (2006.01)
(Continued)

(52) U.S. Cl.
CPC ..... *H01Q 13/203* (2013.01); *H01P 3/06* (2013.01); *H01P 11/005* (2013.01); *H01Q 13/22* (2013.01)

(58) Field of Classification Search
CPC ..... H01P 13/203; H01P 13/20; H01P 13/22; H01P 13/28
(Continued)

(56) References Cited

U.S. PATENT DOCUMENTS 2,981,947 A * 4/1961 Bazan ..... H01Q 21/0062 343/767
3,781,725 A * 12/1973 Yoshida et al. ..... H01Q 13/22 333/237
(Continued)

FOREIGN PATENT DOCUMENTS

CN 1211832 A 3/1999
CN 101164193 A 4/2008
(Continued)

OTHER PUBLICATIONS

International Search Report and Written Opinion dated Jun. 22, 2018 corresponding to International Patent Application No. PCT/CN2018/080218.
(Continued)

*Primary Examiner* — Benny T Lee
(74) *Attorney, Agent, or Firm* — Squire Patton Boggs (US) LLP

(57) ABSTRACT

Radiating cable (100; 100*a;* 100*b;* 100*c;* 100*d;* 100*e*) for radiating electromagnetic energy, comprising an inner conductor (110), an outer conductor (120) arranged radially outside of said inner conductor (110), and an isolation layer (130) arranged radially between said inner conductor (110) and said outer conductor (120), wherein said outer conductor (120) comprises one or more first openings (1202), and wherein said inner conductor (110) comprises a hollow waveguide (1100).

15 Claims, 10 Drawing Sheets

(51) Int. Cl.
*H01P 11/00* (2006.01)
*H01Q 13/22* (2006.01)

(58) Field of Classification Search
USPC ..... 333/237
See application file for complete search history.

(56) References Cited

U.S. PATENT DOCUMENTS

| | | | |
|---|---|---|---|
| 5,467,066 | A | 11/1995 | Schulze-Buxloh |
| 5,467,420 | A | 11/1995 | Rohrmann et al. |

FOREIGN PATENT DOCUMENTS

| | | | |
|---|---|---|---|
| CN | 201112009 | Y | 9/2008 |
| CN | 202268464 | U | 6/2012 |
| CN | 103021554 | A | 4/2013 |
| CN | 105474329 | A | 4/2016 |

OTHER PUBLICATIONS

Chinese Office Action dated Jun. 3, 2020 corresponding to Chinese Patent Application No. 201880022035.1, and concise statement of relevance.

* cited by examiner

RADIATING CABLE AND METHOD OF MANUFACTURING A RADIATING CABLE WITH AN INNER AND OUTER CONDUCTOR, EACH HAVING OPENINGS

FIELD OF THE INVENTION

The disclosure relates to a radiating cable for radiating electromagnetic energy and to a method of providing a radiating cable for radiating electromagnetic energy.

BACKGROUND

Conventional radiating cables, which are coaxial cables e.g. of the so-called leaky coaxial cable (LCX) type, are considered to be suitable for enabling communication in indoor environments like tunnels, mines etc., for signals within certain frequency ranges. Due to increased attenuation of transmitted signals having higher signal frequencies, such conventional LCX are not suitable for the higher signal frequencies, so that separate radiating cables must be provided if different signals within different frequency bands are to be transmitted. This leads to higher costs, less space and an increased amount of installation work.

SUMMARY OF THE INVENTION

Various embodiments provide an improved radiating cable and an improved method of providing a radiating cable which avoid the disadvantages of the prior art.

Some embodiments feature a radiating cable for radiating electromagnetic energy, comprising an inner conductor, an outer conductor arranged radially outside of the inner conductor, and an isolation layer arranged radially between the inner conductor and the outer conductor, wherein the outer conductor comprises one or more first openings, and wherein the inner conductor comprises a hollow waveguide. Advantageously, first signals may be transmitted using the arrangement of the inner conductor in combination with the outer conductor, according to the principle of a coaxial transmission line or a coaxial cable, respectively. In addition, second signals may be transmitted within the hollow waveguide, even simultaneously to the transmission of the first signals. This advantageously enables to provide a radiating cable that facilitates (simultaneous) transmission of signals with different frequencies independent of each other. In other words, an outside, e.g. comprising the radially outer surface, of the hollow waveguide operates as an inner conductor for the coaxial conductor arrangement comprising the inner conductor and the outer conductor, while the radially inner surface of the hollow waveguide (and the wall material of the waveguide to some extent, depending on the skin depth) serves as an additional waveguide for transmitting electromagnetic (EM) waves within the waveguide. The radiating cable according to the embodiments may also be denoted as "radiating hybrid cable (RHC)".

According to an embodiment, the outer conductor comprises a substantially cylindrical cross-section. According to some embodiments, the outer conductor is together with the inner conductor forms a coaxial transmission line or coaxial cable, respectively.

According to an embodiment, the isolation layer may comprise electrically isolating material such as e.g. a foam material and/or air and/or other types of dielectric material. According to a preferred embodiment, at least for some portions of a length of the radiating cable, the isolation layer may be configured to mechanically support the inner conductor in a substantially coaxial position with respect to the outer conductor. For this purpose, especially foam material or dielectric spacers or the like may be provided. Advantageously, the isolation layer provides for electric isolation between the inner conductor and the outer conductor, especially for a galvanic separation between these conductors.

According to an embodiment, the cable is configured to transmit first electromagnetic signals within a VHF and/or UHF frequency range between about 30 MHz to about 3 GHz and to transmit second electromagnetic signals within an SHF and/or EHF and/or THF frequency range between about 3 GHz to about 3 THz.

The VHF frequency range or band, respectively, comprises frequencies between 30 MHz (megahertz) and 300 MHz, the UHF frequency range comprises frequencies between 300 MHz and 3 GHz (gigahertz), the SHF frequency range comprises frequencies between 3 GHz and 30 GHz, the EHF frequency range comprises frequencies between 30 GHz and 300 GHz, and the THF frequency range comprises frequencies between 300 GHz and 3 THz (terahertz). As an example, signals with frequencies within the VHF and/or UHF frequency range may advantageously be transmitted by means of the coaxial conductor arrangement of the inner conductor and the outer conductor, while signals with higher frequencies such as e.g. of the SHF and/or EHF band or THF band may advantageously be transmitted using the hollow waveguide of the inner conductor.

According to a preferred embodiment, the inner conductor constitutes the hollow waveguide, which represents a particularly simple construction. In this configuration, a radially outer surface of the inner conductor cooperates with the radially opposing radially inner surface of the outer conductor to transport electromagnetic waves of associated signals travelling within the coaxial conductor arrangement. Due to the superposition principle, signals transmitted between the inner conductor and the outer conductor do not interfere with a further signal transmitted within the hollow waveguide.

According to further embodiments, the inner conductor may comprise further elements in addition to the hollow waveguide.

According to an embodiment, the waveguide comprises a radially outer surface with a substantially elliptical cross-section, the substantially elliptical cross-section of the radially outer surface comprising a major axis and a minor axis. According to some embodiments, the major axis and the minor axis may comprise different lengths. According to other embodiments, the major axis and the minor axis may comprise substantially identical length, thus effecting a substantially circular cross-section of the radially outer surface of the waveguide.

According to further embodiments, the waveguide comprises a radially inner surface with a substantially elliptical cross-section, the substantially elliptical cross-section of the radially inner surface comprising a major axis and a minor axis.

According to some embodiments, the major axis and the minor axis may comprise different lengths. According to other embodiments, the major axis and the minor axis may comprise substantially identical length, thus effecting a substantially circular cross-section of the radially inner surface of the waveguide.

According to some embodiments, the waveguide may comprise a radially outer surface with a circular cross-section and a radially inner surface with a circular cross-section.

According to further embodiments, the waveguide may comprise a radially outer surface with a circular cross-section and a radially inner surface with an elliptic cross-section with different lengths for the major axis and the minor axis.

According to further embodiments, the waveguide may comprise a radially outer surface with an elliptic cross-section with different lengths for the major axis and the minor axis and a radially inner surface with an elliptic cross-section with different lengths for the major axis and the minor axis, wherein elliptical shape properties such as e.g. a ratio of the length of the major axis and the length of the minor axis may be identical or different for the outer surface and the inner surface, respectively.

According to further embodiments, the waveguide may comprise a radially outer surface with an elliptic cross-section with different lengths for the major axis and the minor axis and a radially inner surface with a circular cross-section.

According to a further embodiment, at least one of the following components comprises at least one length section with corrugations: the inner conductor, the outer conductor, the isolation layer, the hollow waveguide. As an example, for embodiments wherein the inner conductor constitutes the hollow waveguide, the hollow waveguide may be corrugated. Generally, the corrugations increase the mechanical flexibility of the respective component(s) thus facilitating deployment of the radiating cable in the field. According to further embodiments, two or more of the aforementioned components may comprise corrugations, particularly in at least partially overlapping length sections.

According to an embodiment, the at least one first opening serves as an antenna aperture which enables an efficient leakage or transmission of radiation from the interior of the radiating cable to a volume surrounding the radiating cable and/or vice versa. According to a further embodiment, a radiation intensity of the electromagnetic radiation passing the first opening may be controlled by modifying a size and/or shape of the first opening.

According to a further embodiment, at least one of the first openings of the outer conductor comprises a substantially rectangular geometry.

According to a preferred embodiment, the rectangular geometry comprises two longer sides and two shorter sides, wherein the shorter sides are substantially arranged in parallel to a longitudinal axis of the cable, and wherein the longer sides are substantially arranged perpendicular to the longitudinal axis of the cable. In other words, the longer sides of the rectangular geometry of the at least one first opening substantially extend along a circumferential direction of the outer conductor. This enables a particularly efficient leakage or transmission of radiation from the inside of the radiating cable to a surrounding volume and vice versa.

According to further embodiments, the longer sides of the rectangular geometry of the at least one first opening may also be aligned substantially in parallel with a longitudinal axis of the cable, wherein the shorter sides of the rectangular geometry substantially extend along the circumferential direction.

According to further embodiments, different shapes for at least one of the first openings of the outer conductor are also possible, such as e.g. circular shapes or elliptical shapes or polygonal shapes in general.

According to a further embodiment, the inner conductor comprises one or more second openings. In this way, a portion of a signal transmitted within the hollow waveguide may be radiated from the waveguide in the form of electromagnetic waves, travelling radially outwards through the isolating layer and one or more of the first openings. According to Applicant's analysis, the radiated EM waves propagate through the isolating layer and may diffuse through the first opening(s) within the outer conductor, thus also being radiated from the radiating cable, similar to EM waves originating from the pair of the inner and outer conductors and being radiated through the first opening(s).

According to a preferred embodiment, two or more second openings within the inner conductor may be provided along a longitudinal axis of the inner conductor, wherein a spacing between adjacent second openings is preferably constant. Other embodiments are also possible, wherein different values for the spacing between adjacent second openings are provided.

According to a further embodiment, at least one second opening is arranged at an angular position of the inner conductor which corresponds with a minor axis of an elliptical cross-section of a radially inner surface of the waveguide. In other words, at least one of the second openings is arranged at an angular position of the inner conductor where the minor axis intersects with the inner surface of the inner conductor, which effects a particularly high radiation intensity of the EM waves emitted from inside the hollow waveguide radially outwards through the at least one second opening.

However, according to further embodiments, other angular positions for at least one of the second openings are also possible. This particularly enables to control an intensity of radiation related to EM waves emitted through the second openings.

According to further embodiments, a radiation intensity of the EM waves emitted through the second openings may also be controlled by modifying a size and/or shape or geometry of the respective second opening(s).

According to a further embodiment, at least one of the second openings of the inner conductor comprises a substantially rectangular geometry.

According to a preferred embodiment, the rectangular geometry of the second openings comprises two longer sides and two shorter sides, wherein the shorter sides are substantially arranged in parallel to the longitudinal axis of the cable, wherein the longer sides are substantially arranged perpendicular to the longitudinal axis of the cable. In other words, the longer sides of the rectangular geometry of the at least one second opening substantially extend along a circumferential direction of the inner conductor. This enables a particularly efficient leakage or transmission of radiation from the inside of the hollow waveguide to a surrounding volume and vice versa.

According to further embodiments, the longer sides of the rectangular geometry of the at least one second opening may also be aligned substantially in parallel with a longitudinal axis of the cable, wherein the shorter sides of the rectangular geometry substantially extend along the circumferential direction.

According to another embodiment, the at least one second opening substantially comprises a square shape.

According to a further embodiment, at least one of the second openings is associated with a specific one of the first openings, for example arranged such with respect to the specific one of the first openings that EM energy may be radiated through both the second opening and the specific first opening. As an example, the second opening and the specific first opening may be placed at similar or identical length coordinates and/or angular positions within the cable.

According to a further embodiment, at least one of the second openings is arranged at a longitudinal coordinate of the cable (and/or at a respective angular position) such that at least one of the second openings at least partly overlaps with at least one of the first openings, whereby a particularly efficient coupling between an interior of the hollow waveguide and a volume surrounding the radiating cable at the longitudinal coordinate is given. This advantageously ensures that a sufficient amount of EM waves or a corresponding amount of EM radiant energy can be transmitted from the hollow waveguide to the surrounding volume and/or vice versa.

According to a further embodiment, different first openings and/or different second openings are arranged at different angular positions, which enables to influence the direction of radiation in which portions of the electromagnetic energy transported within the cable are irradiated from within the cable to a surrounding volume.

Some embodiments feature a method of manufacturing a radiating cable for radiating electromagnetic energy, the method providing the following steps: providing an inner conductor, providing an outer conductor arranged radially outside of the inner conductor, providing an isolation layer arranged radially between the inner conductor and the outer conductor, wherein the outer conductor comprises one or more first openings, and wherein the inner conductor comprises a hollow waveguide.

BRIEF DESCRIPTION OF THE FIGURES

Further features, aspects and advantages of the present invention are given in the following detailed description with reference to the drawings, where like features are denoted by the same reference signs throughout the drawings and in which.

DETAIL DESCRIPTION OF THE EMBODIMENTS

Figure 1:
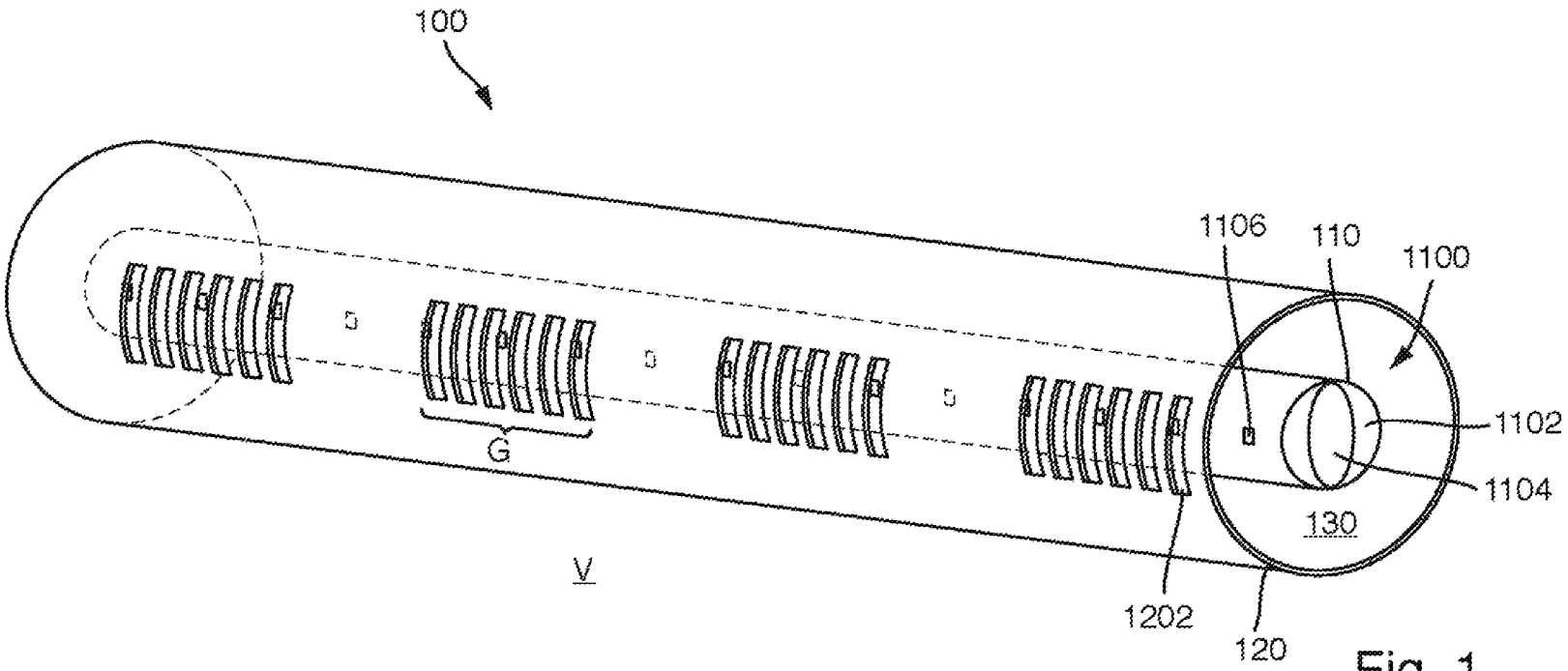
FIG. 1 schematically depicts a perspective view of a radiating cable according to a first embodiment, FIG. 2 schematically depicts a cross-sectional view of the cable according to FIG. 1, FIG. 3 schematically depicts a side view of the cable according to FIG. 1, FIG. 4A schematically depicts a coupling loss related to a hollow waveguide according to an embodiment, FIG. 4B schematically depicts a longitudinal loss related to a hollow waveguide according to an embodiment, FIG. 4C schematically depicts a coupling loss related to a coaxial conductor arrangement according to an embodiment, FIG. 4D schematically depicts a longitudinal loss related to a coaxial conductor arrangement according to an embodiment, FIG. 5A schematically depicts a perspective view of a radiating cable according to a second embodiment, FIG. 5B schematically depicts a cross-sectional view of the radiating cable of FIG. 5A, FIG. 5C schematically depicts a side view of the radiating cable of FIG. 5A, FIG. 6A schematically depicts a perspective view of a radiating cable according to a third embodiment, FIG. 6B schematically depicts a cross-sectional view of the radiating cable of FIG. 6A, FIG. 6C schematically depicts a side view of the radiating cable of FIG. 6A, FIG. 7A schematically depicts a perspective view of a radiating cable according to a fourth embodiment, FIG. 7B schematically depicts a cross-sectional view of the radiating cable of FIG. 7A, FIG. 7C schematically depicts a side view of the radiating cable of FIG. 7A, FIG. 8A schematically depicts a perspective view of a radiating cable according to a fifth embodiment, FIG. 8B schematically depicts a cross-sectional view of the radiating cable of FIG. 8A, FIG. 8C schematically depicts a side view of the radiating cable of FIG. 8A, FIG. 9A schematically depicts a perspective view of a radiating cable according to a sixth embodiment, FIG. 9B schematically depicts a cross-sectional view of the radiating cable of FIG. 9A, FIG. 9C schematically depicts a side view of the radiating cable of FIG. 9A, and FIG. 10 schematically depicts a simplified flowchart of a method according to an embodiment.

FIG. 1 schematically depicts a perspective view of a radiating cable 100 according to a first embodiment. The cable 100 comprises an inner conductor 110, an outer conductor 120 arranged radially outside of the inner conductor 110 and an isolation layer 130 which is arranged radially between the inner conductor 110 and the outer conductor 120. FIG. 1 also illustrates cable 100 comprising one or more second openings 1106, inner surface 1102, and inner 1104.

According to an embodiment, the conductors 110, 120 may e.g. comprise metallic material such as copper or the like.

According to an embodiment, the isolation layer 130 may comprise electrically isolating material such as e.g. a foam material and/or air and/or other types of dielectric material. According to a preferred embodiment, at least for some portions of a length of the radiating cable 100, the isolation layer 130 may be configured to mechanically support the inner conductor 110 in a substantially coaxial position with respect to the outer conductor 120. For this purpose, especially foam material or dielectric spacers (not shown) or the like may be provided. Advantageously, the isolation layer 130 provides for electric isolation between the inner conductor 110 and the outer conductor 120, especially a galvanic separation between these conductors 110, 120.

According to a further embodiment, the cable 100 may comprise an outer jacket (not shown), e.g. comprising electrically isolating material for isolating the cable 100 and/or for protecting the outer conductor 120 and/or further components of the cable 100 from external influences.

Figure 2:
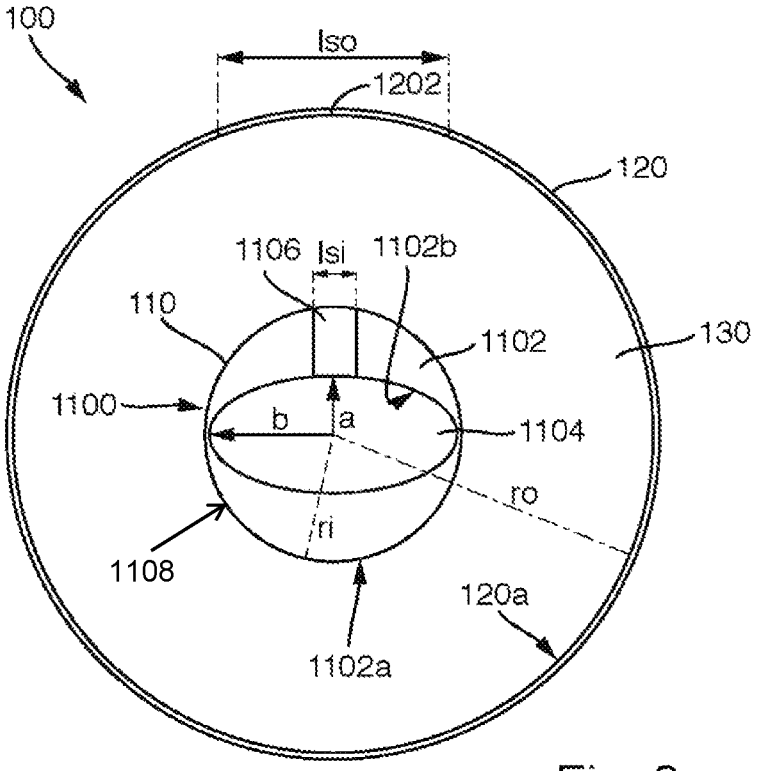

FIG. 2 schematically depicts a cross-sectional view of the cable 100. As can be seen, the inner conductor 110 and the outer conductor 120 form a coaxial conductor arrangement in the sense of a coaxial transmission line, which can be used to transmit first signals within the cable 100 along a first propagation direction substantially perpendicular to the drawing plane of FIG. 2.

The outer conductor 120 comprises first openings 1202, also see FIG. 1, which enable to radiate at least a portion of electromagnetic energy associated with the first signals to a volume "V" surrounding the cable 100. Similarly, electromagnetic waves originating from the surroundings of the cable 100 may also enter the cable 100 through the first openings 1202 and may be further transmitted within the cable 100 in a per se known manner.

According to the principle of the embodiments, the inner conductor 110 comprises a hollow waveguide 1100. Thus, advantageously, the first signals may be transmitted using the arrangement of the inner conductor 110 in combination with the outer conductor 120, according to the principle of a coaxial transmission line or a coaxial cable, respectively. In addition, second signals may be transmitted within the hollow waveguide 1100, even simultaneously to the transmission of the first signals (and also substantially along the first propagation direction substantially perpendicular to the drawing plane of FIG. 2), advantageously enabling providing a radiating cable 100 that facilitates (simultaneous) transmission of different first and second signals, especially with different frequencies, independent of each other. In other words, an outside, e.g. comprising the radially outer surface 1102*a* (FIG. 2), of the hollow waveguide 1100 operates as an inner conductor for the coaxial conductor arrangement comprising the inner conductor 110 and the outer conductor 120, while the radially inner surface 1102*b* of the hollow waveguide 1100 serves as an additional waveguide for transmitting electromagnetic (EM) waves associated with the second signals. In view of this, the radiating cable 100 according to the embodiments may also be denoted as "radiating hybrid cable (RHC)".

According to an embodiment, the outer conductor 120 comprises a substantially cylindrical cross-section, as depicted by FIG. 2. According to some embodiments, the outer conductor 120 together with the inner conductor 110 forms a coaxial transmission line or coaxial cable, respectively, as mentioned above.

According to an embodiment, the cable 100 is configured to transmit first electromagnetic signals within a VHF and/or UHF frequency range between about 30 MHz to about 3 GHz and to transmit second electromagnetic signals within an SHF and/or EHF and or THF frequency range between about 3 GHz to about 3 THz.

Particularly preferred embodiments e.g. are configured for transmission of second signals within the waveguide with frequencies of about 10 GHz and above. The VHF frequency range or band, respectively, comprises frequencies between 30 MHz (megahertz) and 300 MHz, the UHF frequency range comprises frequencies between 300 MHz and 3 GHz (gigahertz), the SHF frequency range comprises frequencies between 3 GHz and 30 GHz, the EHF frequency range comprises frequencies between 30 GHz and 300 GHz, and the THF frequency range comprises frequencies between 300 GHz and 3 THz (terahertz). As an example, signals with frequencies within the VHF and/or UHF frequency range may advantageously be transmitted by means of the coaxial conductor arrangement of the inner conductor 110 and the outer conductor 120, while signals with higher frequencies such as e.g. of the SHF and/or EHF band or THF band may advantageously be transmitted using the hollow waveguide 1100 of the inner conductor 110.

According to a preferred embodiment, the inner conductor 110 constitutes the hollow waveguide 1100, which represents a particularly simple construction. In this configuration, a radially outer surface 1102*a* of the inner conductor 110 cooperates with the radially opposing radially inner surface 120*a* of the outer conductor 120 to transport electromagnetic waves of associated first signals travelling within the coaxial conductor arrangement 110, 120. Due to the superposition principle the first signals transmitted between the inner conductor 110 and the outer conductor 120 do not interfere with the second signals transmitted within the hollow waveguide 1100. FIG. 2 also illustrates cable 100 comprising one or more second openings 1106, isolation layer 130, length lso, and length lsi.

According to further embodiments, the inner conductor 110 may comprise further elements in addition to the hollow waveguide 1100. In this case, the hollow waveguide 1100 together with the further elements form the inner conductor 110.

According to an embodiment, the waveguide 1100 comprises a radially outer surface 1102*a* with a substantially elliptical cross-section, the substantially elliptical cross-section of the radially outer surface 1102*a* comprising a major axis and a minor axis. According to some embodiments, the major axis and the minor axis may comprise different lengths. According to other embodiments, the major axis and the minor axis may comprise substantially identical length, thus effecting a substantially circular cross-section of the radially outer surface 1102*a* of the waveguide. This configuration is depicted by FIG. 2.

According to further embodiments, the waveguide 1100 comprises a radially inner surface 1102*b* with a substantially elliptical cross-section, the substantially elliptical cross-section of the radially inner surface 1102*b* comprising a major axis b and a minor axis a. According to some embodiments, the major axis b and the minor axis a may comprise different lengths, as depicted by FIG. 2. According to other embodiments, the major axis b and the minor axis a may comprise substantially identical length (not shown in FIG. 2), thus effecting a substantially circular cross-section of the radially inner surface 1102*a* of the waveguide.

According to the embodiment of FIG. 2, the waveguide 1100 comprises a radially outer surface 1102*a* with a circular cross-section (having a radius ri) and a radially inner surface 1102*b* with an elliptic cross-section with different lengths of major axis b and minor axis a. Other configurations are also possible and explained further below with reference to FIG. 5A to 9C. Presently, the outer conductor 120 comprises a circular cross-section with radius ro.

According to a further embodiment, at least one of the following components comprises at least one length section with corrugations: the inner conductor 110, the outer conductor 120, the isolation layer 130, the hollow waveguide 1100. As an example, for embodiments wherein the inner conductor 110 constitutes the hollow waveguide 1100, the hollow waveguide may be corrugated. Generally, the corrugations increase the mechanical flexibility of the respective component(s) thus facilitating deployment of the radiating cable in the field. According to further embodiments, two or more of the aforementioned components may comprise corrugations 1108 (FIG. 2), particularly in at least partially overlapping length sections.

Figure 3:
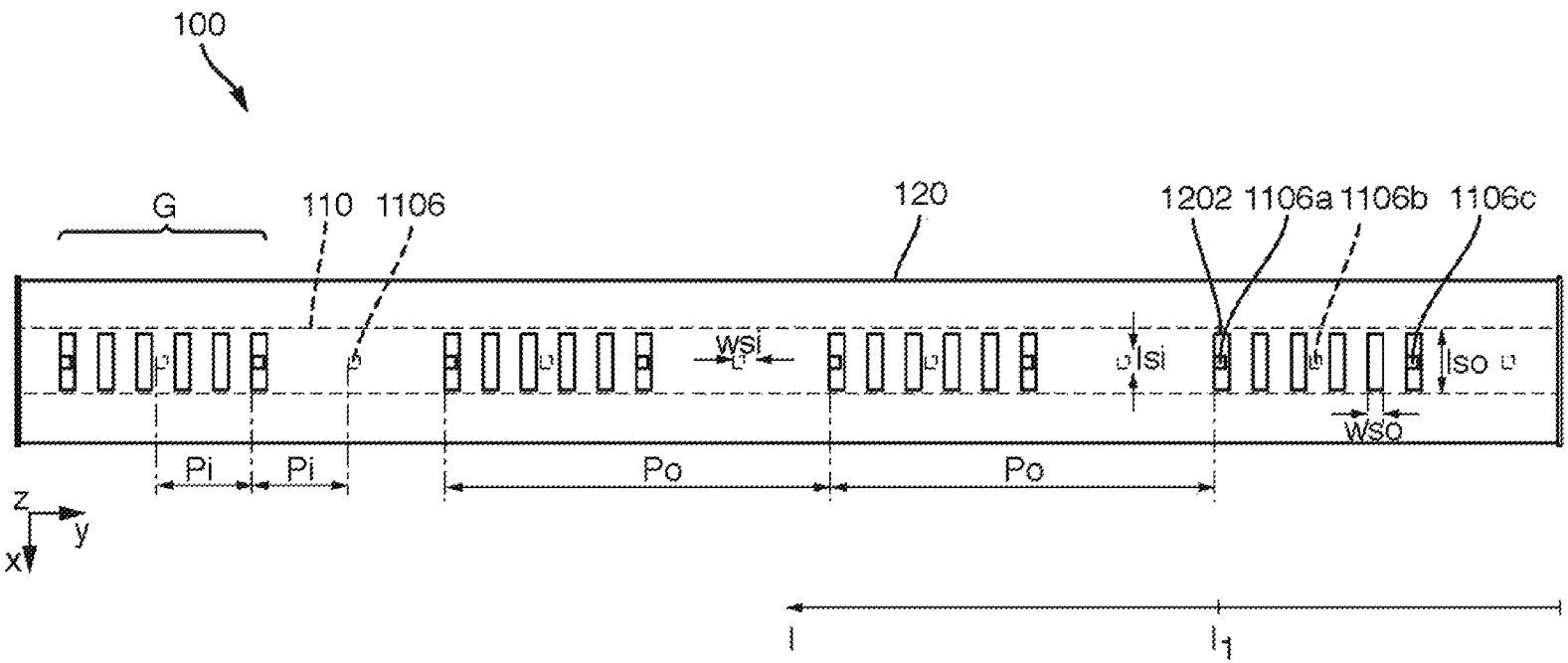

FIG. 3 schematically depicts a side view of the cable 100. As can be seen, a plurality of first openings 1202 are present in the outer conductor 120, wherein only one of the first openings is provided with a reference sign for the sake of clarity. Presently, the first openings 1202 are grouped within groups G of six first openings 1202 each. A spacing between adjacent groups G is denoted with reference sign Po.

According to a further embodiment, the at least one first opening 1202 serves as an antenna aperture which enables an efficient leakage or transmission of radiation from the inside of the radiating cable 100 to a surrounding volume V (FIG. 1) and vice versa. According to a further embodiment, a radiation intensity of the electromagnetic radiation passing the first opening(s) 1202 may be controlled by modifying a size and/or shape of the first opening(s) 1202.

According to a further embodiment, at least one of the first openings 1202 of the outer conductor 120 comprises a substantially rectangular geometry, see FIG. 3.

According to a preferred embodiment, the rectangular geometry comprises two longer sides and two shorter sides, wherein the shorter sides are substantially arranged in parallel to a longitudinal axis (see length dimension 1) of the cable 100, and wherein the longer sides are substantially arranged perpendicular to the longitudinal axis 1 of cable 100. In other words, the longer sides of the rectangular geometry of the at least one first opening 1202 substantially extend along a circumferential direction of the outer conductor 120. This enables a particularly efficient leakage or transmission of radiation from the interior of the radiating cable 100 to a volume surrounding the radiating cable 100 and vice versa. Presently, in FIG. 3, one of the longer sides of a first opening is denoted with reference sign lso, and one of the shorter sides is denoted with reference sign wso.

According to further embodiments, the longer sides of the rectangular geometry of the at least one first opening 1202 may also be aligned substantially in parallel with a longitudinal axis of the cable, wherein the shorter sides of the rectangular geometry substantially extend along the circumferential direction, see FIG. 7A, 7C explained further below. FIG. 3 also illustrates inner conductor 110.

According to further embodiments, different shapes for at least one of the first openings 1202 (FIG. 3) of the outer conductor 120 are also possible, such as e.g. circular shapes or elliptical shapes or polygonal shapes in general.

According to a further embodiment, the inner conductor 110, i.e. the hollow waveguide 1100, see FIG. 2, comprises one or more second openings 1106. This way, a portion of a signal transmitted within the hollow waveguide 1100 may leave the waveguide in the form of electromagnetic waves, travelling radially outwards through the isolating layer 130 (FIGS. 1 and 2). According to Applicant's analysis, the radiated EM waves propagate through the isolating layer 130 and may diffuse through the first opening(s) 1202 within the outer conductor 120, thus also being radiated from the radiating cable 100, similar to EM waves originating from the pair of the inner and outer conductors 110, 120 and being radiated through the first opening(s) 1202.

According to a preferred embodiment, two or more second openings 1106*a*, 1106*b*, 1106*c* (FIG. 3) within the inner conductor 110 may be provided along a longitudinal 1 axis of the inner conductor 110 (or the waveguide 1100 which forms the inner conductor), wherein a spacing Pi between adjacent second openings is preferably constant. Other embodiments are also possible, wherein different values for the spacing between adjacent second openings are provided.

According to a further embodiment, at least one second opening 1106 is arranged at an angular position of the inner conductor 110 which corresponds with the minor axis a thereof, see FIG. 2. In other words, at least one of the second openings 1106 is arranged at an angular position of the inner conductor 110 where the minor axis a intersects with the inner surface 1102*b* (FIG. 2) of the inner conductor 110, which effects a particularly high radiation intensity of the EM waves emitted from the interior of the hollow waveguide 1100 radially outwards through the at least one second opening 1106.

However, according to further embodiments, other angular positions for at least one of the second openings are also possible. This particularly enables to control an intensity of radiation related to EM waves emitted through the second openings.

According to further embodiments, a radiation intensity of the EM waves emitted through the second openings 1106 may also be controlled by modifying a size and/or shape or geometry of the respective second opening(s) 1106.

According to a further embodiment, at least one of the second openings 1106 of the inner conductor 110 comprises a substantially rectangular geometry with a length lsi, see FIG. 3, and a width wsi.

According to a further embodiment, the rectangular geometry of the second openings comprises two longer sides and two shorter sides (not shown in FIG. 3), wherein the shorter sides are substantially arranged in parallel to the longitudinal axis of the cable, wherein the longer sides are substantially arranged perpendicular to the longitudinal axis of the cable. In other words, the longer sides of the rectangular geometry of the at least one second opening substantially extend along a circumferential direction of the inner conductor. This enables a particularly efficient leakage or transmission of radiation from the interior of the hollow waveguide to a volume surrounding the hollow waveguide and vice versa.

According to further embodiments, the longer sides of the rectangular geometry of the at least one second opening may also be aligned substantially in parallel with a longitudinal axis of the cable, wherein the shorter sides of the rectangular geometry substantially extend along the circumferential direction.

According to a further embodiment, at least one of the second openings 1106*a* (FIG. 3) is associated with a specific first opening 1202.

According to a further embodiment, at least one of the second openings 1106*a* is arranged at a longitudinal coordinate 11 of the cable 100 such that at least one of the second openings 1106*a* at least partly overlaps with at least one of the first openings 1202, whereby a particularly efficient coupling between an interior 1104 (FIG. 2) inside the wall 1102 (FIG. 2) of the hollow waveguide 1100 and a volume V (FIG. 1) surrounding the radiating cable 100 at the longitudinal coordinate 11 is given. This advantageously ensures that a sufficient amount of EM waves or a corresponding amount of EM radiant energy can be transmitted from the hollow waveguide 1100 to the volume surrounding the hollow waveguide 1100 and vice versa. In FIG. 3, the further second opening 1106*c* also overlaps with an associated first opening, while the other second opening 1106*b* does not overlap with a first opening.

Figure 4A:
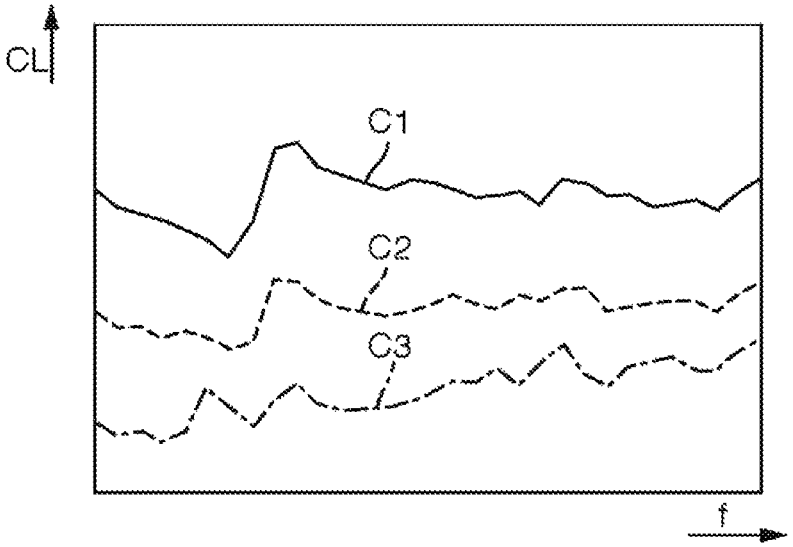

For the configuration of the cable 100 explained above with reference to FIGS. 1 to 3, an electromagnetic field simulation has been carried out, and the results are presented in the following FIGS. 4A to 4D, wherein FIG. 4A shows radiation characteristics of the elliptical waveguide 1100 (FIG. 2) presented in form of a coupling loss (CL) diagram (coupling loss CL over frequency f) according to IEC 61196-4 with all three polarizations ("Radial", see curve C1, "Parallel", see curve C2, and "Orthogonal", see curve C3), where "Radial" has an E-field vector parallel to a z-axis (FIG. 3), "Parallel" has an E-field vector parallel to a y-axis (FIG. 3) and "Orthogonal" has an E-field vector parallel to an x-axis (FIG. 3). The Radial radiation dominates with a value around 95 dB, see curve C1.

According to the present example, the waveguide 1100 (FIG. 2) is designed with the following geometry parameters, wherein an operation at a first mode with frequencies between 17 to 20 GHz is enabled: minor axis a=4 mm (millimeter), major axis b=8.3 mm, radius of outer conductor 120 ro=21.65 mm, lsi=3 mm (length of second opening 1106), wsi=3 mm (width of second opening 1106), lso=15 mm (length of first opening 1202), and wso=3 mm (width of first opening 1202).

Figure 4B:
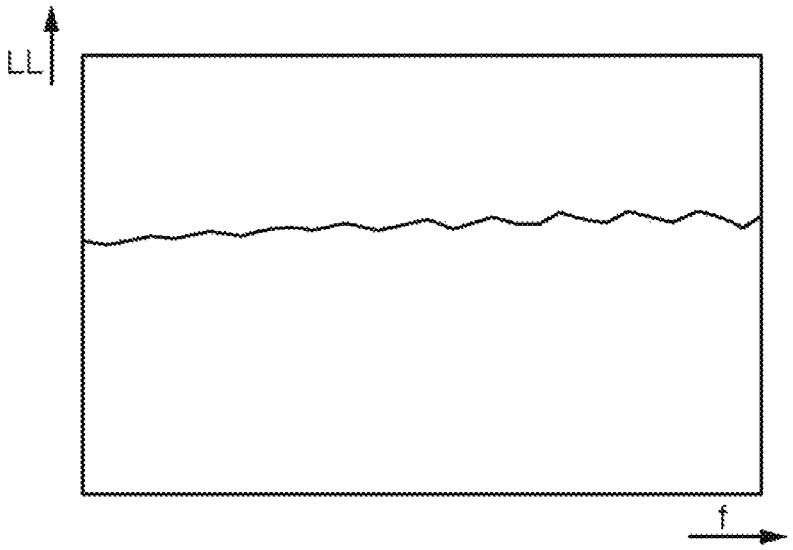

FIG. 4B shows the so-called longitudinal loss LL (over frequency f) of the waveguide 1100. As an example, the waveguide 1100 allows transmission in range of 17 GHz to 20 GHz with an attenuation of around 17.5 dB per 100 m.

Figure 4C:
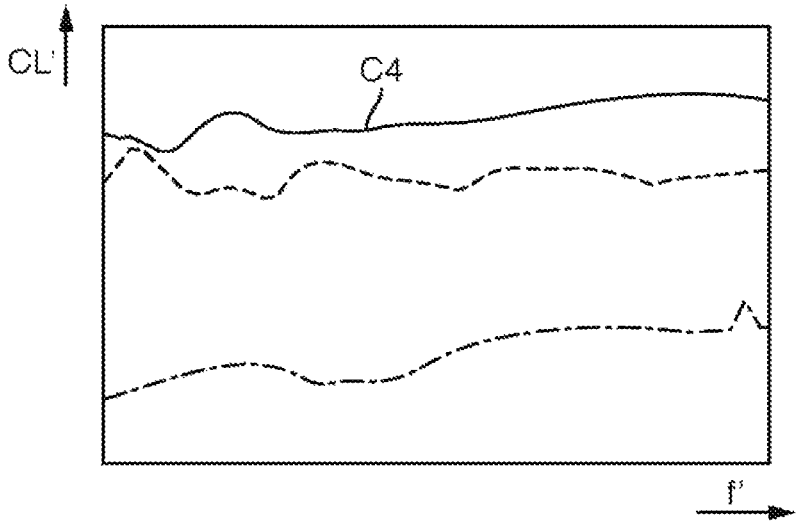

FIG. 4C shows the coupling loss CL' (over frequency f) of the "leaky coaxial cable" implemented by means of the conductor arrangement 110, 120 of FIG. 1 with an exemplary aperture size of lso=15 mm and wso=3 mm of the first opening(s) 1202. A radial orientation, see curve C4, dominates with a value of about 62 dB in a frequency range between 500 MHz and 2700 MHz.

Figure 4D:
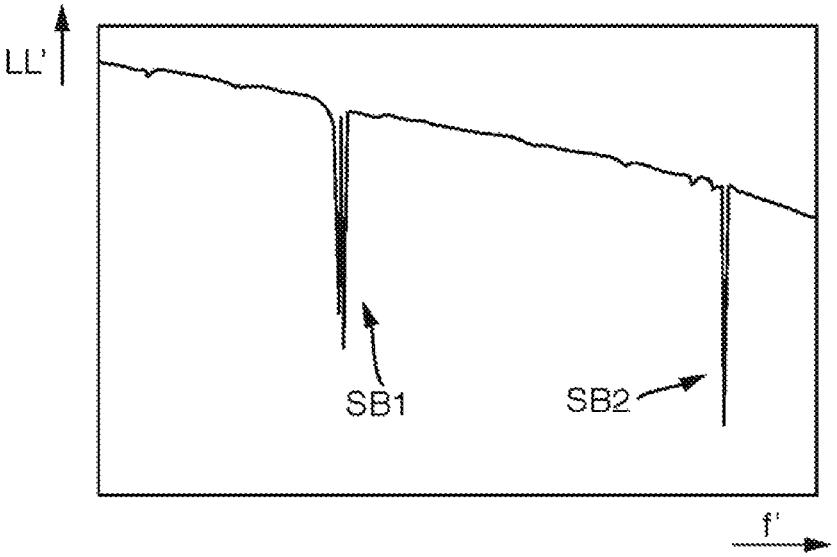

FIG. 4D shows a longitudinal loss LL' (over frequency f) of the "leaky coaxial cable" implemented by means of the conductor arrangement 110, 120 of FIG. 1. The cable 100 transmits first signals with an attenuation less then 13 dB/100 m except stop bands SB1, SB2 at 1.3 GHz-1.4 GHz and 2.65 GHz-2.75 GHz, which may be conditioned by means of a periodicity of slot groups G of the first openings 1202 on the outer conductor 120 (FIG. 3).

Figure 5A:
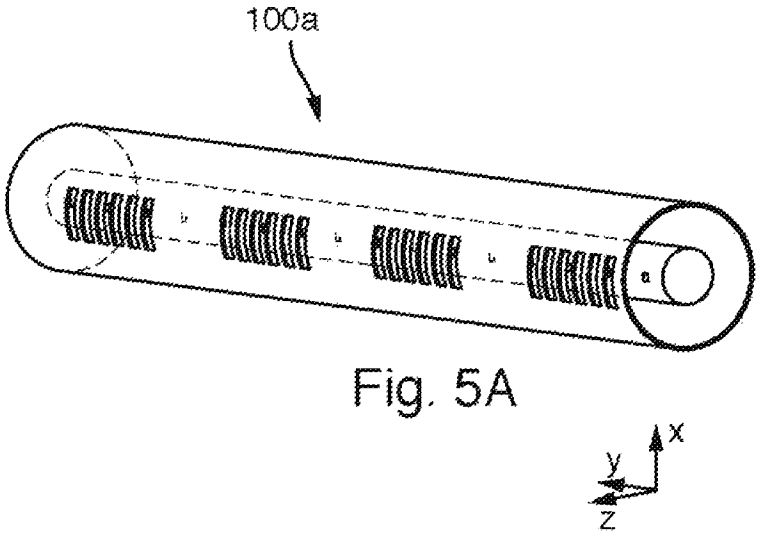
Figure 5B:
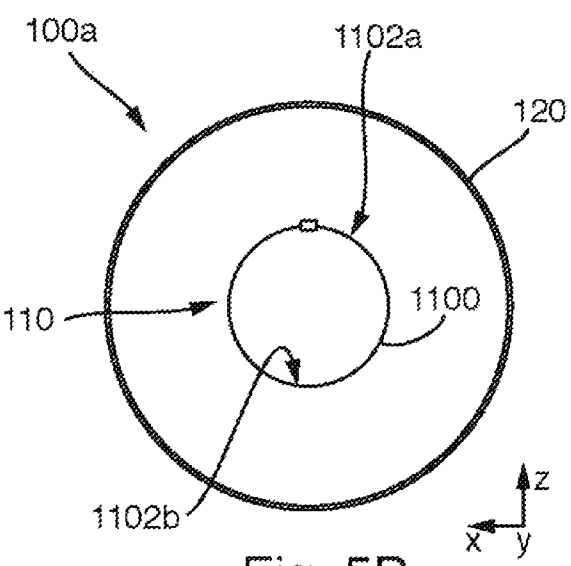
Figure 5C:
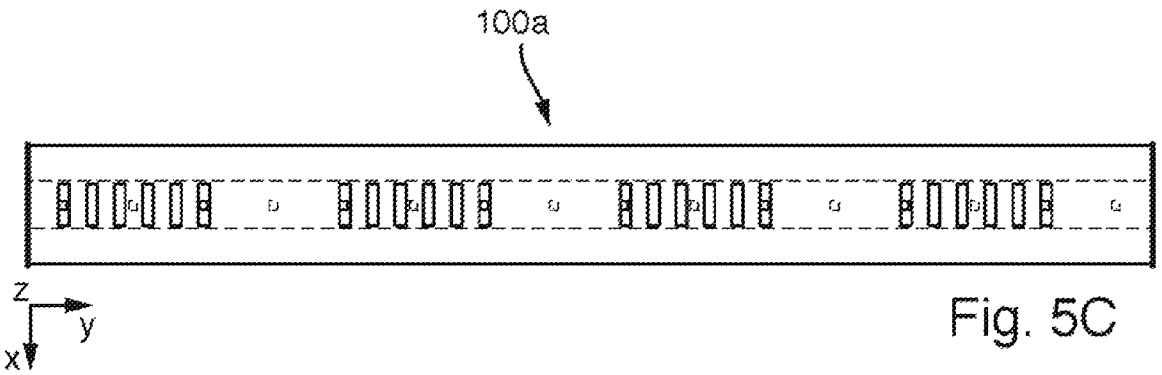

FIGS. 5A, 5B, 5C schematically depict a radiating cable 100*a* according to a second embodiment, wherein the waveguide 1100 that represents the inner conductor 110 comprises a radially outer surface 1102*a* with a circular cross-section and a radially inner surface 1102*b* with a circular cross-section, as shown in FIG. 5B. Each of FIGS. 5A, 5B, and 5C also illustrate indications of the x-axis, y-axis, and z-axis.

Figure 6A:
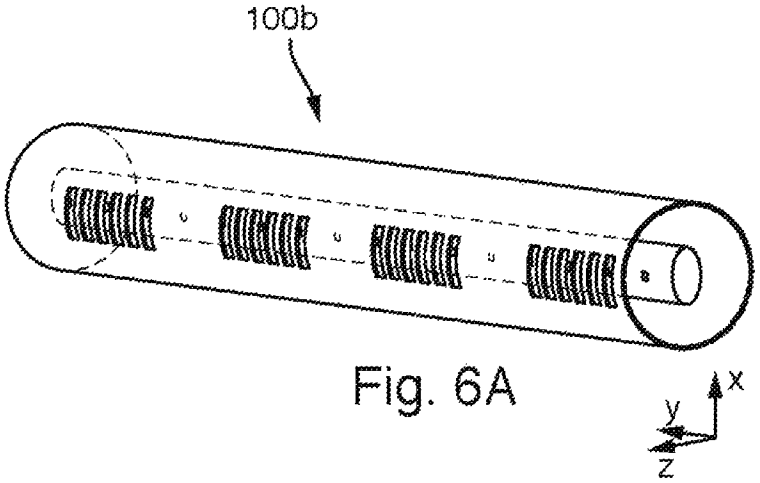
Figure 6B:
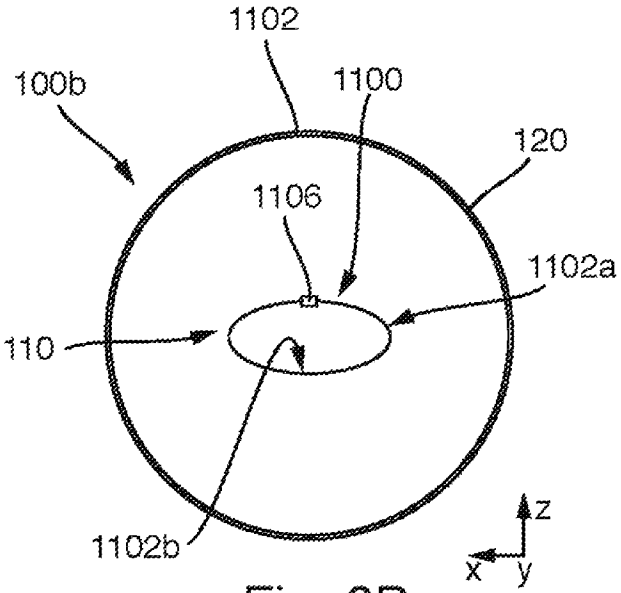
Figure 6C:
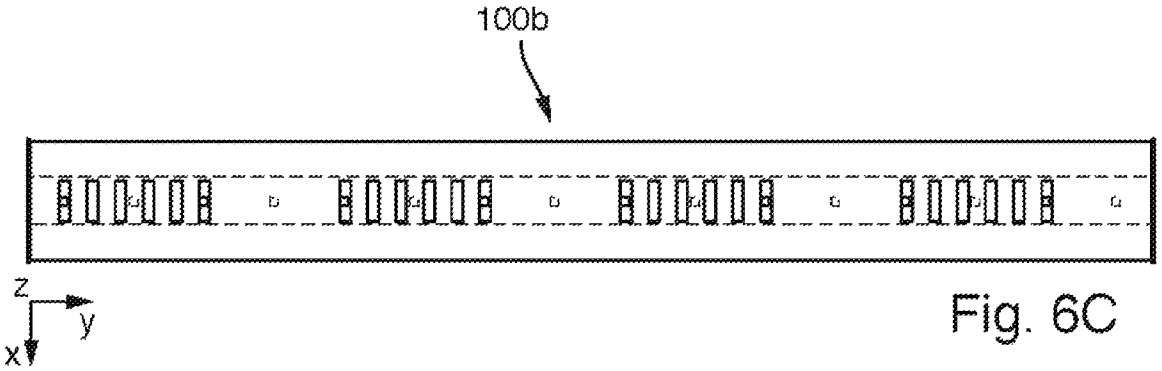

FIGS. 6A, 6B, 6C schematically depict a radiating cable 100*b* according to a third embodiment, wherein the waveguide 1100 comprises a radially outer surface 1102*a* with an elliptic cross-section with different lengths of major axis and minor axis and a radially inner surface 1102*b* with an elliptic cross-section with different lengths for the major axis and the minor axis, as shown in FIG. 6B. FIG. 6B also illustrates cable 100*b* comprising one or more second openings 1106, outer surface 1102, hollow waveguide 1100, inner conductor 110, and outer conductor 120. Each of FIGS. 6A, 6B, and 6C also illustrate indications of the x-axis, y-axis, and z-axis.

Figure 7A:
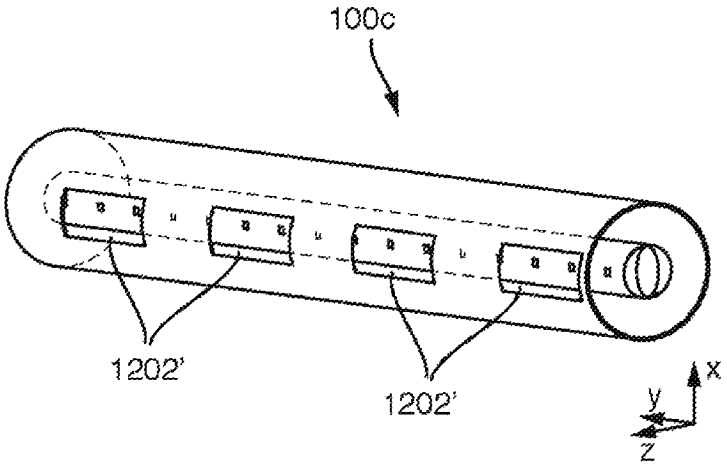
Figure 7B:
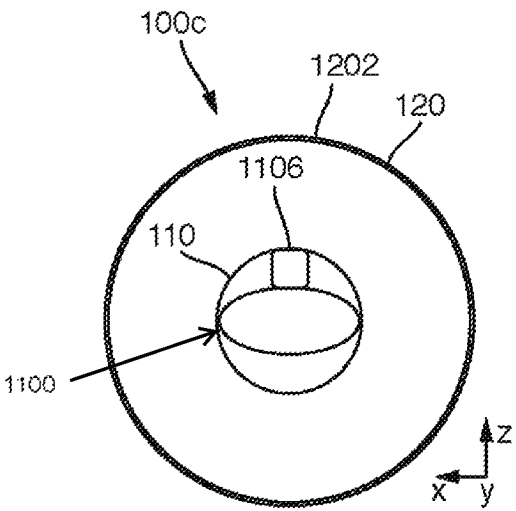
Figure 7C:
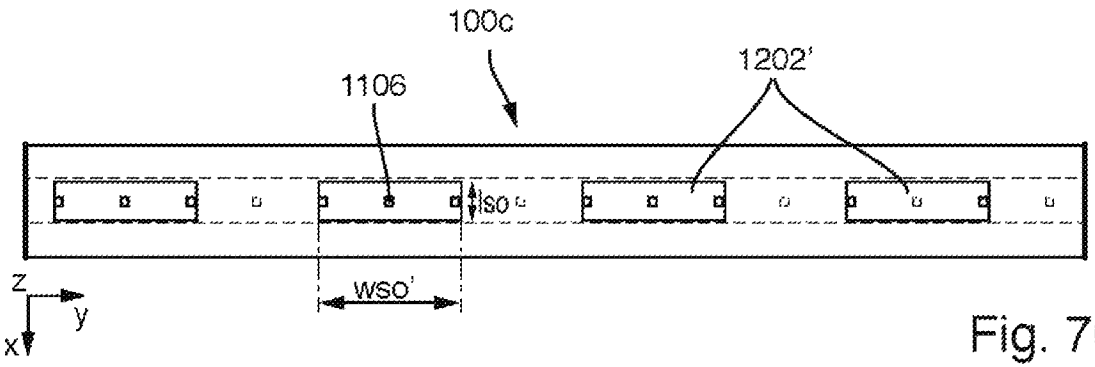

FIGS. 7A, 7B, 7C schematically depict a radiating cable 100*c* according to a fourth embodiment, wherein the waveguide comprises a shape similar to FIG. 2. As can be seen from FIGS. 7A and 7C, the first openings 1202' are larger than those of FIG. 1, 2, wherein the first openings 1202' of the cable 100*c* comprise a "width" wso' (FIG. 7C) along the longitudinal axis 1 (FIG. 3) of the cable 100*c* (FIG. 7B) which is greater than their "length" lso (FIG. 7C) measured perpendicular to the longitudinal axis. Presently, three second openings 1106 (FIGS. 7B and 7C) are associated (and at least partly overlap) with a specific first opening 1202'. FIG. 7B also illustrates inner conductor 110, outer conductor 120, and first openings 1202. Each of FIGS. 7A, 7B, and 7C also illustrate indications of the x-axis, y-axis, and z-axis.

Figure 8A:
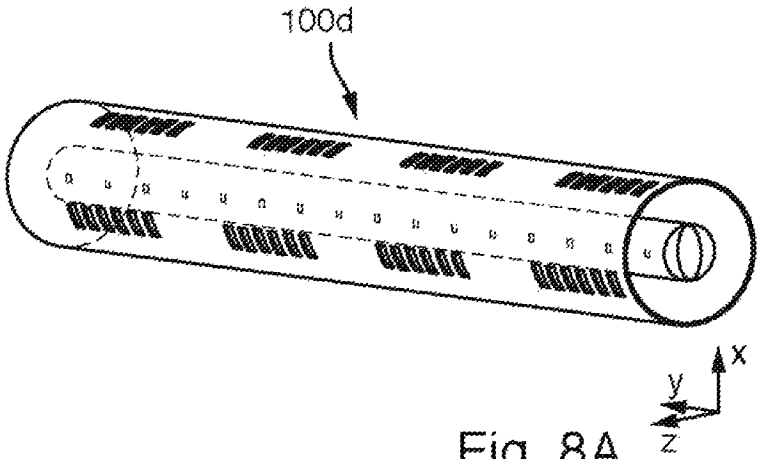
Figure 8B:
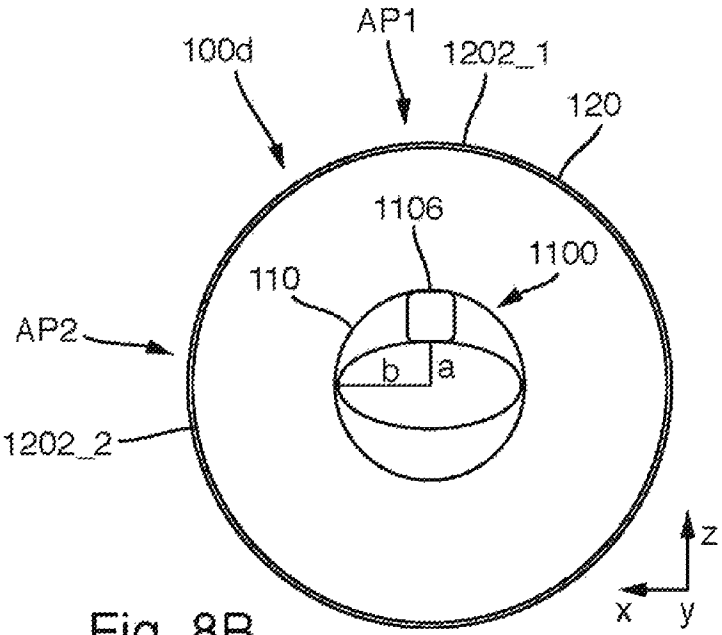
Figure 8C:
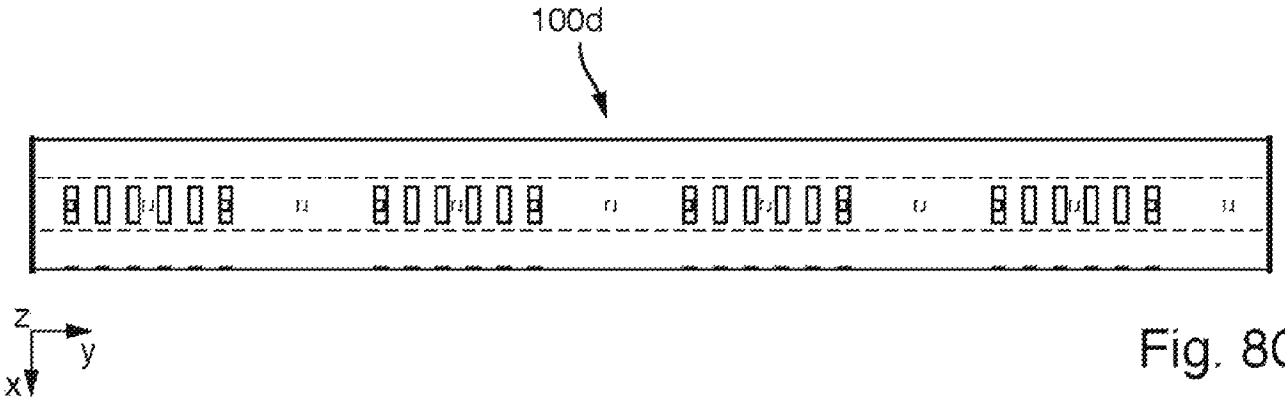

FIGS. 8A, 8B, 8C schematically depict a radiating cable 100*d* according to a fifth embodiment, wherein the waveguide comprises a shape similar to FIG. 2. Presently different first openings 1202_1, 1202_2 (FIG. 8B) are arranged at different angular positions AP1, AP2 (FIG. 8B), which enables to influence the direction of radiation in which portions of the electromagnetic energy transported within the cable 100*d* are irradiated from within the cable to a surrounding volume. Presently, a first number of first openings 1202_1 is arranged at an angular position AP1 that corresponds with a direction of the minor axis a (FIG. 8B) of the interior elliptical shape of the hollow waveguide 1100, while a second number of first openings 1202_2 is arranged at a different angular position AP2 that corresponds with a direction of the major axis b (FIG. 8B) of the interior elliptical shape of the hollow waveguide 1100. FIG. 8B also illustrates cable 100*d* comprising one or more second openings 1106, inner conductor 110, and outer conductor 120. Each of FIGS. 8A, 8B, and 8C also illustrate indications of the x-axis, y-axis, and z-axis.

Figure 9A:
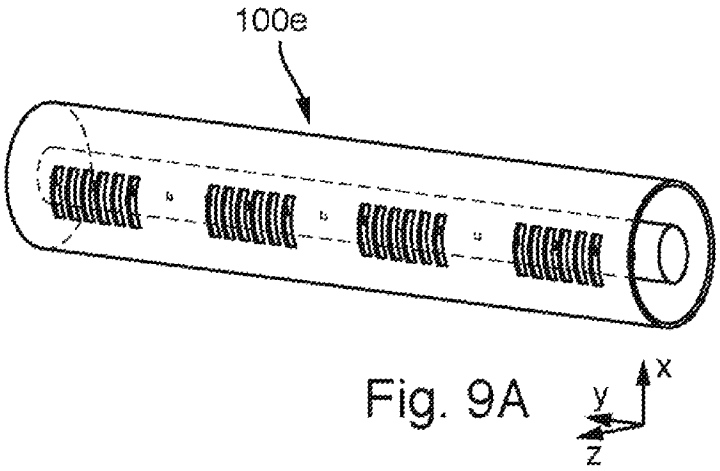
Figure 9B:
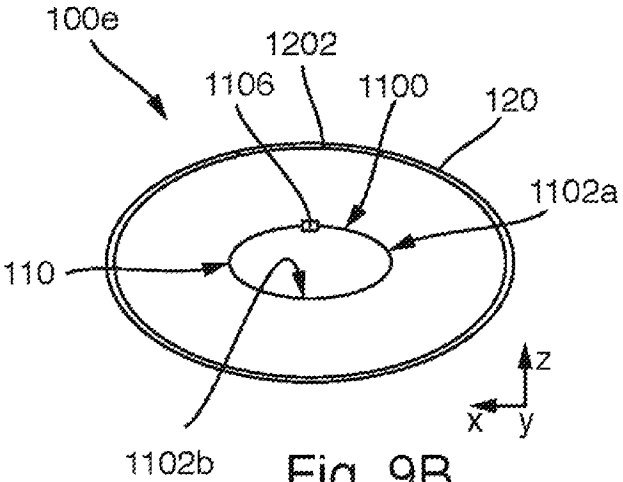
Figure 9C:
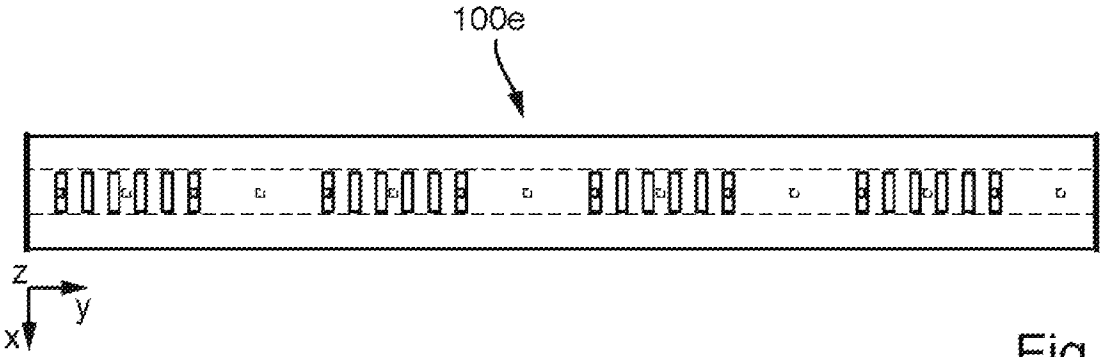

FIGS. 9A, 9B, 9C schematically depict a radiating cable 100*e* according to a sixth embodiment, wherein the waveguide 1100 comprises an elliptical shape having an outer surface 1102*a* and an inner surface 1102*b* with elliptical cross-section, as shown in FIG. 9B. Also, the outer conductor 120 has an elliptical shape in this embodiment. According to this embodiment, second signals e.g. of the SHF band may be transmitted within the hollow waveguide 1100, while first signals e.g. of the VHF band are transmitted within the "coaxial" conductor arrangement 110, 120 in a so-called "virtual TEM Mode" conditioned due to elliptical form of the outer conductor 120, as shown in FIG. 9B. FIG. 9B also illustrates cable 100*e* comprising one or more second openings 1106 and first openings 1202. Each of FIGS. 9A, 9B, and 9C also illustrate indications of the x-axis, y-axis, and z-axis.

Figure 10:
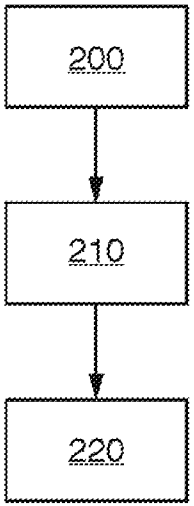

FIG. 10 schematically depicts a simplified flowchart of a method according to an embodiment. The method comprises the following steps: providing at step 200 an inner conductor 110 (FIG. 1), providing at step 210 (FIG. 10) an outer conductor 120 (FIG. 1) arranged radially outside of the inner conductor 110, providing at step 220 an isolation layer 130 (FIG. 1) arranged radially between the inner conductor 110 and the outer conductor 120, wherein the outer conductor 120 comprises one or more first openings 1202 (FIG. 1), and wherein the inner conductor 110 comprises a hollow waveguide 1100 (FIG. 1). According to further embodiments, the sequence of steps 200, 210, 220 may also be altered or at least some of the steps may be performed at least partly simultaneously.

According to a further embodiment, at a beginning (and/or end) of the cable 100 (FIG. 1), two feeding mechanisms may be applied. First signals may be provided to the cable 100 for transmission via the coaxial conductor arrangement 110, 120 by means of a coaxial connector (not shown). Advantageously, this feeding of first signals is independent of any feeding of second signals to the waveguide 1100.

As an example, first signals fed to the cable 100 by the coaxial connector may cause TEM waves to propagate within the coaxial conductor arrangement 110, 120. As a further example, such first signals may comprise frequencies in the range from 20 MHz to 2700 MHz.

According to a further embodiment, a second connector (not shown) may be provided at the cable 100 which enables to feed the waveguide 1100 with second signals, e.g. at a frequency range between 15 GHz and 20 GHz.

The first and second connector may also be placed at different length coordinates 1 of the cable (and, according to some embodiments, not even necessarily at an end of the cable).

The concept according to the embodiments enables efficient transmission of different signals of different frequency bands like VHF and SHF at the same time while only requiring one single radiating cable 100, 100*a*, 100*b*, 100*c*, 100*d*, 100*e* according to the embodiments. According to further embodiments, it is possible to enable communication/transmission of e.g. VHF and EHF or SHF and EHF signals at the same time by modifying the geometry of the conductors 110, 120 and the waveguide 1100.

The principle according to the embodiments offers many benefits like: —Enabling broadband communication of multiple bands with one element: The presented cable enables e.g. broadband indoor communication of several frequencies at different ranges like VHF and SHF/EHF at the same time.

—Saving costs: Instead of using two separate conventional cables to offer communication at VHF and SHF/EHF, one cable according to the embodiments will save much in production costs. —Saving Space: By installing one cable according to the embodiments, instead of two conventional cables, space will be saved, which fulfills a big need especially at narrow places like tunnels, corridors etc. —Less Installation Work: Without the proposed solution, more effort of installation will be needed in order to handle two separate conventional cables. So the proposed cable saves effort of installation.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

A person of skill in the art would readily recognize that steps of various above-described methods can be performed by programmed computers and/or automated production systems. Herein, some embodiments are also intended to cover program storage devices, e.g., digital data storage media, which are machine or computer readable and encode machine-executable or computer-executable programs of instructions, wherein the instructions perform some or all of the steps of the above-described methods. The program storage devices may be, e.g., digital memories, magnetic storage media such as a magnetic disks and magnetic tapes, hard drives, or optically readable digital data storage media. The embodiments are also intended to cover computers programmed to perform the steps of the above-described methods.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The invention claimed is:

1. A radiating cable for radiating electromagnetic energy, comprising an inner conductor, an outer conductor arranged radially outside of said inner conductor, and an isolation layer arranged radially between said inner conductor and said outer conductor, wherein said outer conductor comprises one or more first openings, wherein said inner conductor comprises a hollow waveguide, and wherein said inner conductor comprises one or more second openings.

2. The cable according to claim 1, wherein said cable is configured to transmit first electromagnetic signals within a VHF portion of a frequency range between about 30 MHz to about 3 GHz.

3. The cable according to claim 1, wherein said waveguide comprises a radially outer surface with a substantially elliptical cross-section.

4. The cable according to claim 1, wherein said waveguide comprises a radially inner surface with a substantially elliptical cross-section.

5. The cable according to claim 1, wherein at least one of the following comprises at least one length section with corrugations: the inner conductor, the outer conductor, the isolation layer, the hollow waveguide.

6. The cable according to claim 1, wherein at least one of said first openings comprises a substantially rectangular geometry.

7. The cable according to claim 1, wherein said cable is configured to transmit second electromagnetic signals within a THF portion of a frequency range between about 3 GHz to about 3 THz.

8. The cable according to claim 1, wherein at least one of said second openings comprises a substantially rectangular geometry.

9. The cable according to claim 1, wherein at least one of said second openings is configured with respect to a corresponding one of said first openings, such that electromagnetic energy is radiated through both said second opening and said corresponding first opening.

10. The cable according to claim 1, wherein at least one of said second openings is configured at a longitudinal coordinate of said cable such that said at least one of said second openings at least partly overlaps with at least one of said first openings.

11. The cable according to claim 1, wherein different ones of said at least one first openings or different ones of said at least one second openings are configured at different angular positions.

12. The cable according to claim 1, wherein said cable is configured to transmit second electromagnetic signals within an EHF portion of a frequency range between about 3 GHz to about 3 THz.

13. The cable according to claim 1, wherein said cable is configured to transmit first electromagnetic signals within a UHF portion of a frequency range between about 30 MHz to about 3 GHz.

14. The cable according to claim 1, wherein said cable is configured to transmit second electromagnetic signals within a SHF portion of a frequency range between about 3 GHz to about 3 THz.

15. A method of manufacturing a radiating cable for radiating electromagnetic energy, said method comprising:

providing an inner conductor, providing an outer conductor arranged radially outside of said inner conductor, providing an isolation layer arranged radially between said inner conductor and said outer conductor, wherein said outer conductor comprises one or more first openings, wherein said inner conductor comprises a hollow waveguide, and wherein said inner conductor comprises one or more second openings.

* * * * *